United States Patent [19]

Jorgensen

[11] Patent Number: 5,056,760

[45] Date of Patent: Oct. 15, 1991

[54] T-SLOT SHEAVE

[75] Inventor: Eldon N. Jorgensen, Indianapolis, Ind.

[73] Assignee: The United States of America as represented by the Secretary of the Navy, Washington, D.C.

[21] Appl. No.: 507,264

[22] Filed: Apr. 2, 1990

[51] Int. Cl.[5] ..... B66D 3/04

[52] U.S. Cl. ..... 254/406; 254/402

[58] Field of Search ..... 254/402, 403, 405, 406, 254/411, 415

[56] References Cited

U.S. PATENT DOCUMENTS

| | | | |
|---|---|---|---|
| 811,191 | 1/1906 | Whiteside | 254/406 |
| 875,387 | 12/1907 | Stam | 254/405 |
| 1,672,823 | 8/1927 | McMillan | 254/405 |
| 2,382,049 | 8/1945 | Frankhouser | 254/402 |
| 2,449,703 | 9/1948 | Johnson | 254/406 |
| 2,523,440 | 12/1947 | McEnary | 254/406 |
| 2,555,059 | 5/1951 | Schrader | 254/406 |
| 2,633,329 | 3/1953 | Le Bus | 254/406 |
| 2,649,282 | 8/1953 | Fate, Jr. | 254/406 |
| 2,754,084 | 7/1956 | Le Bus, Sr. | 254/406 |
| 2,762,607 | 9/1956 | Anderson | 254/406 |
| 4,056,257 | 11/1977 | Kaiser | 254/406 |

*Primary Examiner*—Daniel P. Stodola
*Assistant Examiner*—Charles T. Riggs, Jr.
*Attorney, Agent, or Firm*—Robert W. Adams

[57] ABSTRACT

A sheave that has the advantage of being able to be quickly coupled to a cable, and quickly decoupled from the cable. A further advantage is that the shaft of the pulley on which the cable rides is journaled at each end in side members that interlock when the sheave is in its closed position to support the shaft both from above the pulley, and from below. Other advantages include that the interlock is an arcuate T-shaped extension in the rotatable side member and a corresponding arcuate T-slot groove with which it engages in the stationary side member. The rotatable side member is affixed to the shaft of the pulley and is operable to rotate about the shaft from its closed and interlocked position to its open and disengaged position whereat the pulley is exposed such that the cable, cord or the like may be coupled or decoupled to the pulley. In the open position the side members only are connected by way of the pulley's shaft, whereas in the closed and load bearing position the side members additionally are supported to one another by the T-slot interlock that is both above and below the pulley. A slip ring lock is included to retain the side members in their interlocked position.

10 Claims, 2 Drawing Sheets

T-SLOT SHEAVE

BACKGROUND OF THE INVENTION

The invention relates to the field of pulleys and, more specifically, to pulleys that are intended to support a line such as a cable or cord. The grooved wheel of most such pulleys are housed in assemblies that require the line to be threaded onto the wheel in order for the line to be suspended by the assembly, wherein the assembly is in turn suspended by a hook to an anchored support member. The assemblies may be known as snatch blocks, tackle blocks or pulley blocks, for example, or when used in combination, they may be known as block and tackle assemblies.

The invention permits the line to be placed in the pulley without passing or threading it through the pulley and onto the wheel by a free end, an advantage that allows the line to remain secured at both of its ends while the line is fitted to the pulley. Others also have devised arrangements to fit a line to a pulley without the need for threading. They include the development disclosed by M. W. Schrader in U.S. Pat. No. 2,555,059, wherein a snatch block is shown and described as having a housing with a stationary side member that is attached to a snatch hook from which it can be suspended. The stationary side member supports one end of the journal pin on which the pulley's wheel is mounted. The other end of the journal pin is fitted to the opposite side member, which side member can rotate about the pin to open the pulley and allow a line to be placed on the pulley's wheel. Then, the moveable side member can be rotated into a closed position that prevents the line from being disloged from the wheel. A hook shaped extension near the top of the moveable side member fits into an arcuate groove in the stationary side member that has an undercut or modified dovetail bottom portion to which the tip of the hook conforms. A locking feature for when the snatch block is in its closed position, is formed by a spring loaded plunger in the stationary side member that snaps into a bore in the moveable side member. The pulley's wheel is somewhat larger in diameter than the diameter of the journal pin, and rides on a layer of lubricant that is introduced into the hub of the pin at a fitting of conventional design. The lubricant is communicated by passages which open into a brass bushing at the interface between the pin and the wheel of the pulley. The bushing is disposed on the pin and engages the bore of the pulley so that the pulley is journaled directly on the bushing for rotation between the stationary and moveable side members. A washer is slipped on the pin on each side of the wheel to separate the wheel from the stationary side member on one side and from the moveable side member on the other side. The front end of the journal pin has a head that extends forward beyond the moveable side member. The opposite end of the pin is threaded to receive a cap nut that extends rearward beyond the stationary side member.

Other pulley assemblies that have been designed to avoid threading the line through the pulley include the devices that are disclosed in a large group of patents that show swing away side members. The body of art is represented by U.S. Pat. No. 2,449,703 to C. B. Johnson, U.S. Pat. No. 2,633,329 to F. L. LeBus; U.S. Pat. No. 2,649,282 to J. E. Fate, Jr., and U.S. Pat. No. 2,754,084 to F. L. LeBus, Sr. Each shows a side member that is rotatable about the shaft of the pulley and engages with the pin that connects the hook of the snatch block to the pulley assembly. Other examples of the prior art are U.S. Pat. No. 2,762,607 to D. Anderson, and U.S. Pat. No. 4,056,257 to H. E. Kaiser, which disclose side members that each have a hook. The hooks are rotated apart about the shaft of the pulley to open the assembly and permit the introduction of the line, and are rotated back together to close the assembly and capture the line.

SUMMARY OF THE INVENTION

A primary object of the present invention is to provide a pulley assembly having a cable or line receiving sheave which is mounted in a block having a swingably mounted side member capable of being readily swung to a released position to enable an intermediate portion of the cable or line to be introduced onto the sheave or removed from it while the end portions of the cable or line remain fastened or otherwise at their positions, respectively, one to the working load and the other to the apparatus or thing supporting or working on the load. A further object is to provide such an assembly wherein the assembly and the load bearing strength of the pulley are not weakened by the design of the feature for readily connecting and disconnecting the cable or line. Still further, an object is to eliminate parts that can be dropped, dislodged or lost when the assembly is being fitted to the cable or line, or being removed from it, which object is especially advantageous to the user during adverse working or weather conditions. Still, a further object of the invention is to provide an assembly of extremely simple construction having a single journal for rotatably mounting the sheave and the moveable side member together with a simple locking mechanism for retaining the assembly in its closed position. And, a further object of the invention is to provide a pulley assembly wherein the moveable side member when in the closed position is secured from movement in all but a rotational direction by engagement with the stationary side member in a T-slot groove such that forces applied to the sheave by the cable or line may be communicated equally to the moveable and stationary side members without appreciable distortion of the journal that supports the sheave.

Various other objects and advantages of the present invention will hereinafter become more fully apparent from the following description of the drawing, illustrating a preferred embodiment thereof.

DESCRIPTION OF A PREFERRED EMBODIMENT

Figure 1:
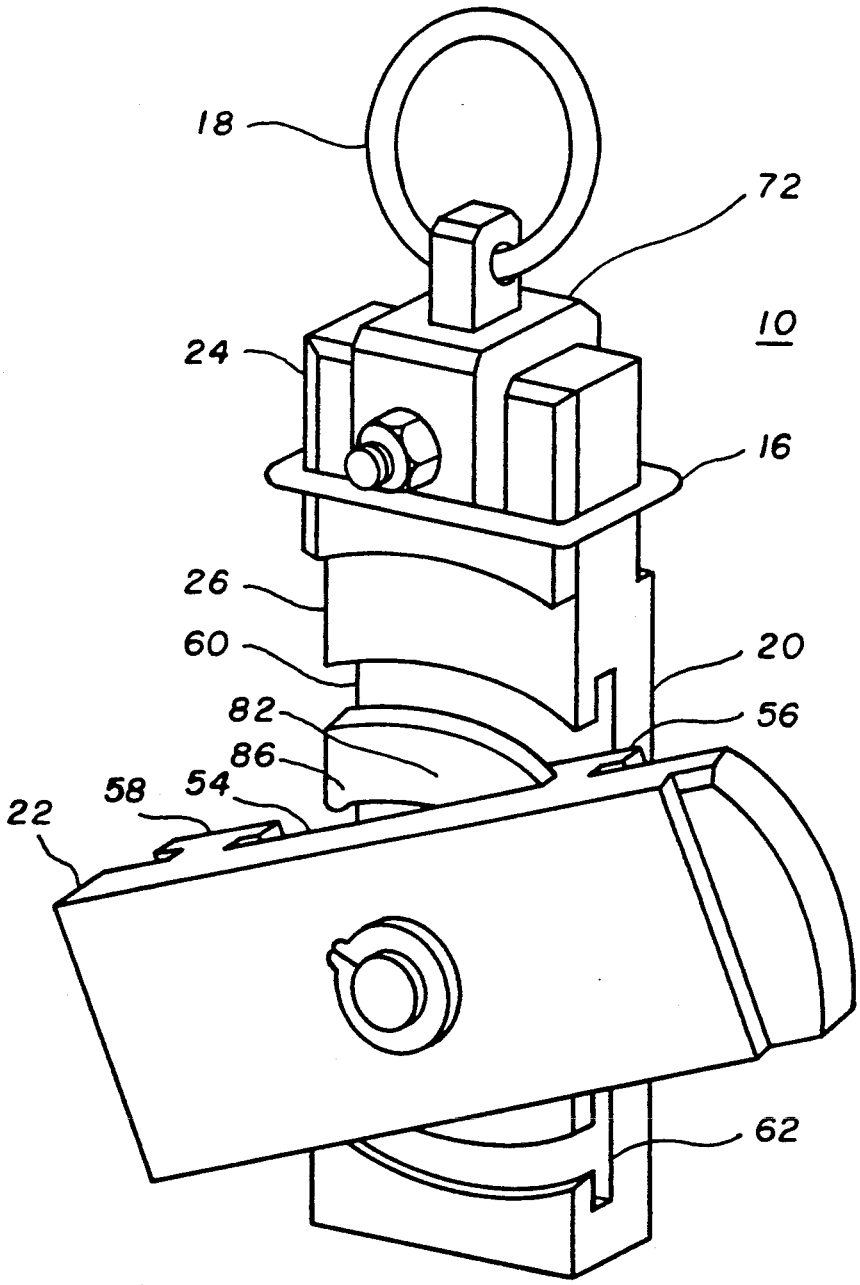
FIG. 1 is a pictorial view of a preferred embodiment of the invention.

The sheave assembly is designated as assembly 10 throughout the figures, just as are the other components of the embodiment generally designated throughout the figures by their respective number. Assembly 10 includes broadly a block, designated generally 12, a sheave designated 14, a retaining ring designated 16, and an attachment ring designated 18.

The block structure 12 of assembly 10 is shown in FIG. 1 to include stationary side member 20 that extends from top to bottom thereof, and moveable side member or plate 22. Stationary side member 20 has an upper end 24, and a lower end 26 designated with an upper section 28 and a lower section 30 wherein the front faces 32 and 34, respectively, of the sections are recessed from upper end 24 to accommodate plate 22. An intermediate section 36 of lower end 26 further is recessed to accommodate sheave 14.

Sheave 14 is journaled on shaft or pin 38. One end of pin 38 is supported by bushing 40 in bore 42 of intermediate section 36. Plate 22 is rotatably mounted on the other end of journal pin 38, and is supported by bushing 44 installed in bore 46. A clip 48 slips into a groove on each end of pin 38 and acts as a keeper for the assembled parts. Clips 48 may be easily removable for disassembly and cleaning of the parts, or repair and replacement.

Figure 3:
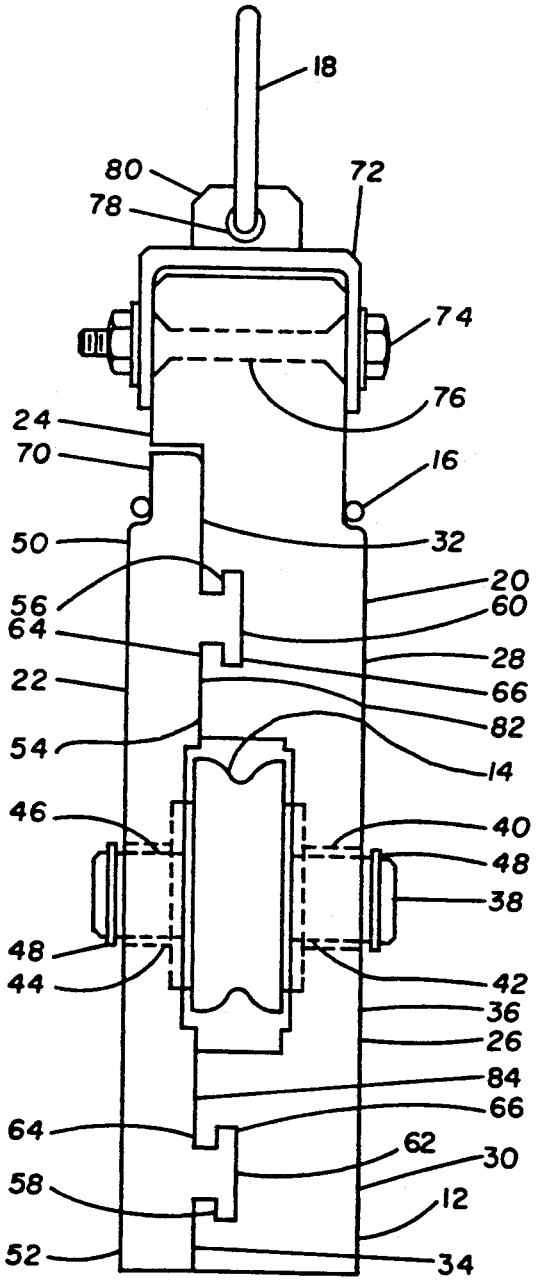
FIG. 3 is a side view of the embodiment, partially in cutaway form to show the sheave, its journal and adjacent parts, and the T-slot groove in the stationary side member and the T-slot extension in the moveable side member, both above and below the sheave, substantially along the vertical centerline of the frontal view shown in FIG. 2.

Moveable side member or plate 22 includes upper free end 50 and lower free end 52. Protruding from inner side 54 of plate 22 are extensions 56 and 58. Grooves 60 and 62 corresponding to extensions 56 and 58, respectively, are in the recessed front faces 32 and 34 of stationary side member 20. The extensions and grooves are arcuate as shown in FIGS. 1 and 3, such that groove 60 slidably 60 slidably receives and securely engages extension 56 when plate 22 is rotated to the closed position shown in FIGS. 2 and 3. Likewise, groove 62 slidably receives and snugly engages extension 58.

Grooves 60 and 62 are T-slot grooves wherein the head of the T extends into the body of side member 20, and the bottom of the leg of the T is at the front face of stationary side member 20. Extensions 56 and 58 also are T-shaped with the leg of the T extending outward from the front face of plate 22 and the head of the T being parallel to the front face of plate 22 at the outward end of the leg. The T-slot shape provides a large surface area of engagement between T-top ends 66 of plate 22, and lips 64 of side member 20. The inclusion of grooves both above and below sheave 14 retains in a quick connect and disconnect device, the strength and stability when the assembly is in its closed position that heretofore was available only in a sheave assembly having fixedly attached and immovable side members. The leg of the T should be wide enough to be strong and avoid breakage. It may be convenient to make the leg approximately twice as wide as the top or head of the T.

Figure 2:
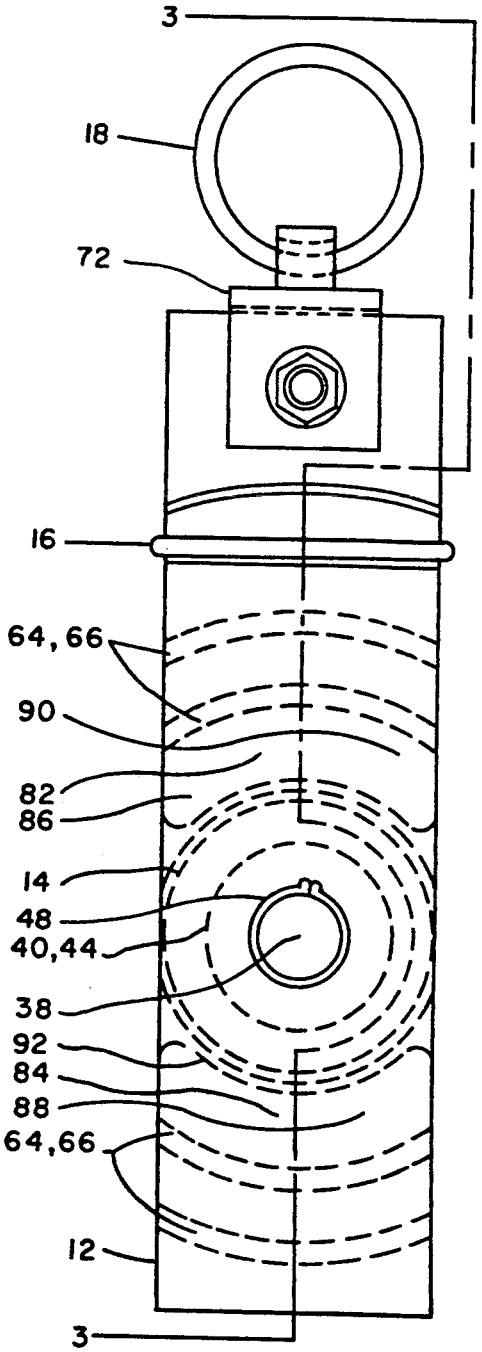
FIG. 2 is a frontal view of the embodiment in its closed position.

The locking mechanism shown in the drawing to prevent plate 22 from opening, is a 360 degree retaining ring that is fitted to loosely encircle the perimeter of upper end 24 of block 12. Ring 16 is preferred for its simplicity and ease of operation. The ring is shown in FIGS. 2 and 3 in its lock position. The assembly is unlocked by raising ring 16 above tip 70 of plate 22 as shown in FIG. 1. With ring 16 in the unlocked position, plate 22 may be rotated to permit entry of the cable or line onto sheave 14, and then returned to its closed position to securely enclose the cable or line. When the sheave assembly is hung vertically, retaining ring 16 automatically will return by the force of its weight to the locked position encircling tip 70 of plate 22 and upper section 28 of side member 20, after it is released. Although ring 16 is shown, and is preferred for most applications of the invention, another locking mechanism may be substituted without departing from the invention. The substitution of another mechanism that is more secure when in the locked position, may be desirable when the sheave assembly might be moved into or through an orientation that departs substantially from the vertical, for example.

Attachment ring 18 is fitted to block 12 by bracket 72. Bracket 72 is attached to block 12 with nut and bolt 74 which passes through bore 76. Ring 18 supports block 12 at aperture 78 of flange 80, but otherwise is free to move.

Segment 82 is the portion of upper section 28 at front face 32 between groove 60 and intermediate section 36 whereat pulley 14 is located. Segment 84 is the portion of lower section 30 at front face 34 between groove 62 and intermediate section 36. Segments 82 and 84 have first ends 86 and 88, respectively; and, in a clockwise direction therefrom, second ends 90 and 92, respectively. FIG. 1 shows first end 86 exposed by plate 22, with plate 22 covering second end 90 (not shown) of segment 82. If plate 22 is rotated to a position beyond horizontal, second end 90 will be exposed, with plate 22 covering first end 86. In FIG. 2, plate 22 is shown in its closed position, covering both first end 86 and second end 90 of segment 82, and both first end 88 and second end 92 of segment 84. When first end 86 is exposed, second end 90 is covered by plate 22; and, vice-versa, i.e., when second end 90 is exposed, first end 86 is covered by plate 22.

Sheave 14 is intended to support a cable or other line, not shown. Sheave 14 may be integral to or fixedly mounted on shaft 38. In the embodiment shown bushing 40 is included such that when sheave 14 rotates, shaft 38 will rotate within the bushing. However, shaft 38 could be stationary within stationary side member 20, in which case sheave 14 would be selected to be rotatable on the stationary shaft.

When a line is intended to be introduced to or removed from assembly 10, the operator will slide retaining ring 16 upward until it clears plate 22. Then, plate 22 will be rotated as shown in FIG. 1. When plate 22 is rotated to its fully open position, both upper free end 50 and lower free end 52 will clear stationary side member 20. Extensions 56 and 58 will exit grooves 60 and 62, respectively, which will permit unobstructed access to sheave 14.

If the line is to be removed, the operator will find it convenient to first rotate plate 22 to its fully open position before he begins to remove the line. Thereby, the greatest amount of clearance will be available near upper free end 50. As the line is removed near upper free end 50, it may be convenient to rotate plate 22 slightly toward its closed position to facilitate final removal of the line by increasing the amount of clearance that will be available near lower free end 52.

Attachment of a line is convenient if the steps for removal are reversed. The line is first introduced to sheave 14 near lower free end 52 before plate 22 is in its fully open position. Then, installation is completed near upper free end 50 as plate 22 is rotated to its fully open position. Thereafter, plate 22 is returned to its closed position with the line fully installed on sheave 14; and, retaining ring 16 is returned to its locked position by slipping it, or releasing it to drop, over upper free end 50.

From the foregoing description, it may readily be seen that the present invention comprises a new, unique and exceedingly useful sheave assembly which constitutes a considerable improvement over the prior art. Obviously, many modifications and variations of the present invention are possible in light of the above teachings. It is, therefore, to be understood that within the scope of the appended claims the present invention may be practiced otherwise than as specifically described.

What is claimed is:

1. A sheave assembly comprising block structure having an upper end and a recessed lower end, a journal pin extending through and detachably secured to the recessed lower end of the block structure, a pulley rotatably mounted on the journal pin in the recessed lower end of the block, an attachment means secured to the upper end of the block for supporting the structure in suspension, said block having a separate portion defining one side of its lower end, said side constituting a plate having an upper free end and a lower free end and swingably mounted on the journal pin for exposing the upper end lower parts of the pulley in a first position of said plate and for closing said one side of plate on the upper and lower parts of the pulley in a second position of the plate, said recessed lower end of the block structure including upper and lower sections having front faces that are recessed from said upper end of the block structure to accommodate the free ends of the plate when in said second position, the free ends of said plate being provided on their inner side with an extension having a T-shaped cross section which is arcuately bowed from end-to-end thereof, said upper and lower sections in said lower end having a groove opening into their recessed front faces in which said plate extensions are slidably received and fully engaged when the plate is moved to said second position for closing the pulley side and are fully disengaged when the plate is moved to said first position, and keeper means for releasably securing the plate with its free ends in engagement with the upper and lower sections of the recessed lower end of the block structure, wherein a segment of said upper section is between said groove opening and said pulley, and said segment has a first end and a second end, with said plate covering said first end with said lower free end of the plate and exposing said second end when the plate is in said first position, with said plate covering both said first end and said second end with said upper free end of the plate when said plate is in said second position, and with said plate covering said second end with said upper free end of the plate and exposing said first end when the plate is rotated into a position between the first and second positions, such that when said first end is exposed the plate is covering said second end, and when said second end is exposed the plate is covering said first end, whereby said plate is in continuous bearing contact with said segment such that said extensions are maintained in planar alignment with their respective grooves when the plate is moved to said first position with the extensions and the grooves fully disengaged, to assure against misalignment of the extensions with the grooves when the plate is rotated from said first position to re-engagement of the extensions with their respective grooves.

2. A sheave assembly for supporting a line, comprising a stationary side member with an upper end and a lower end, bowed grooves in the front face of said lower end, a journal pin extending through and detachably secured to said lower end intermediate said bowed grooves, a sheave rotatably mounted on the journal pin, an attachment means secured to the upper end of the stationary side member for supporting the assembly, a separate portion defining one side of the assembly adjacent the front face of the lower end of the stationary side member, said portion constituting an elongated plate having a first free end and a second free end and swingably mounted on the journal pin adjacent one end thereof to open the assembly to the upper part of the sheave in a first position of said plate for attaching or removal of the line, and to close the assembly in a second position of the plate for encasing the line on the sheave, the free ends of said plate being provided on their inner side opposite said grooves with extensions that are bowed from end-to-end thereof and that are slidably received and fully engaged by said grooves when the plate is moved to said second position for closing the assembly and are fully disengaged from said grooves when the plate is moved to said first position, wherein a segment of said front face is between one of said grooves and said sheave, said segment has a first end and a second end, with said plate covering said first end with said second free end of the plate and exposing said second end when the plate is in said first position, with said plate covering both said first and second ends of the segment with said first free end of the plate when said plate is in said second position, and with said plate covering said second end with said first free end of the plate and exposing said first end when the plate is rotated into a position that is between the first and second positions, such that when said first end is exposed the plate is covering said second end, and when said second end is exposed the plate is covering said first end, whereby said plate is in continuous bearing contact with said segment such that the extensions are maintained in planar alignment with its respective grooves when the plate is moved to said first position wherein the extensions and the grooves are fully disengaged, to assure against misalignment of the extensions with the grooves when the plate is rotated from said first position to re-engagement of the extensions with the grooves.

3. The sheave assembly of claim 2 wherein said grooves are T-slots in which the head of the T-slot is within said stationary side member with the leg of the T-slot extending to its front face, and said extensions are T-shaped with the leg of the T-shape extending from the plate toward the front face of the lower end of the stationary side member, such that the head of the T-shape extension engages the head of the T-slot when the plate is in said second position.

4. The sheave assembly of claim 3 wherein said stationary side member and said plate are journaled on bushings to said journal pin, and said journal pin is fixedly attached to said sheave for rotation therewith.

5. The sheave assembly of claim 4 further comprising keeper means for releaseably securing the assembly in its locked position with the free ends of the plate in engagement with the lower end of the stationary side member.

6. The sheave assembly of claim 5 wherein said keeper means is a retaining ring that encircles the upper end of the stationary side member in the assembly's unlocked position, and wherein the front face of the lower end of the stationary side member is recessed such that the plate substantially fits within the recess and the retaining ring encircles the stationary side member and the plate within the recess in the assembly's locked position.

7. The sheave assembly of claim 2 wherein said stationary side member and said plate are journaled on bushings to said journal pin, and said journal pin is fixedly attached to said sheave for rotation therewith.

8. The sheave assembly of claim 7 wherein said grooves are T-slots in which the head of the T-slot is within said stationary side member with the leg of the T-slot extending to its front face, and said extensions are T-shaped with the leg of the T-shape extending from the plate toward the front face of the lower end of the stationary side member, such that the head of the T-shape extension engages the head of the T-slot when the plate is in said second position.

9. The sheave assembly of claim 2 wherein said attachment means comprises an assembly having a ring loop, a bracket having an upstanding flange and an aperture therein through which the ring loop passes, said bracket also having vertical opposing side panels that project downwardly over the upper end of the stationary side member, each side panel having an aperture in alignment with the other and in alignment with a bore in the upper end of the stationary side member, and the attachment means further comprises a bolt that extends through said aligned apertures in the side panels and said bore in the upper end of the stationary side member, and is secured by a nut threadable on said bolt.

10. The sheave assembly of claim 9 wherein said grooves are T-slots in which the head of the T-slot is within said stationary side member with the leg of the T-slot extending to its front face, and said extensions are T-shaped with the leg of the T-shape extending from the plate toward the front face of the lower end of the stationary side member, such that the head of the T-shape extension engages the head of the T-slot when the plate is in said second position.

* * * * *